US010715905B2

(12) United States Patent
Wen

(10) Patent No.: US 10,715,905 B2
(45) Date of Patent: Jul. 14, 2020

(54) NOISE CANCELLING EARPHONE INTEGRATED WITH FILTER MODULE

(71) Applicant: Transound Electronics Co., Ltd., Dongguan, Guangdong (CN)

(72) Inventor: Tseng-Feng Wen, Dongguan (CN)

(73) Assignee: TRANSOUND ELECTRONICS CO., LTD., Dongguan, Guangdong (CN)

( * ) Notice: Subject to any disclaimer, the term of this patent is extended or adjusted under 35 U.S.C. 154(b) by 0 days.

(21) Appl. No.: 16/538,743

(22) Filed: Aug. 12, 2019

(65) Prior Publication Data

US 2020/0177986 A1 Jun. 4, 2020

(30) Foreign Application Priority Data

Dec. 3, 2018 (CN) ..... 2018 2 2013506 U

(51) Int. Cl.
*H04R 1/10* (2006.01)
*G10K 11/178* (2006.01)

(52) U.S. Cl.
CPC ..... *H04R 1/1083* (2013.01); *G10K 11/17853* (2018.01); *G10K 11/17857* (2018.01); *H04R 1/1016* (2013.01); *G10K 2210/1081* (2013.01); *H04R 2460/01* (2013.01)

(58) Field of Classification Search
CPC ..... H04R 1/1083; H04R 1/1016; H04R 2460/01; G10K 11/17853; G10K 11/17857; G10K 2210/1081
See application file for complete search history.

(56) References Cited

U.S. PATENT DOCUMENTS 10,460,718 B2 * 10/2019 Sibbald ..... H04R 1/1083
2012/0314882 A1 * 12/2012 Sibbald ..... H04R 1/1016 381/71.6

* cited by examiner

*Primary Examiner* — Mark Fischer
(74) *Attorney, Agent, or Firm* — Leong C. Lei

(57) ABSTRACT

A noise cancelling earphone includes an earphone housing, a filter module, and a speaker. The filter module and the speaker are installed in the earphone housing. The filter module includes a printed circuit board, a microphone, and a filter unit. The microphone and the filter unit are respectively disposed on the printed circuit board. The filter unit is electrically connected between the microphone and the speaker. The filter module is arranged in the earphone. The structural design is reasonable, the space is effectively utilized, the structure is compact, and the assembly is convenient.

10 Claims, 5 Drawing Sheets

NOISE CANCELLING EARPHONE INTEGRATED WITH FILTER MODULE

BACKGROUND OF THE INVENTION

Field of the Invention

The present invention relates to a noise cancelling earphone, and more particularly to a noise cancelling earphone integrated with a filter module.

Description of the Prior Art

A noise cancelling earphone generally adopts the noise cancelling technology on the wire control board, that is, a filter unit is provided to generate a signal having an opposite phase and equal amplitude relative to a noise signal, so as to offset the noise signal, thereby achieving the purpose of noise reduction. However, the existing noise cancelling earphones generally have problems such as poor structural design, troublesome assembly, and unsatisfactory filtering effect.

Accordingly, the inventor of the present invention has devoted himself based on his many years of practical experiences to solve these problems.

SUMMARY OF THE INVENTION

In view of the shortcomings of the prior art, the primary object of the present invention is to provide a noise cancelling earphone integrated with a filter module. The filter module is arranged in the earphone. The structural design is reasonable, the space is effectively utilized, the structure is compact, and the assembly is convenient. In particular, the stability and reliability of the connection between a microphone and a filter unit are ensured, and the filtering effect is improved.

In order to achieve the above object, the present invention adopts the following technical solutions:

A noise cancelling earphone comprises an earphone housing, a filter module, and a speaker. The filter module and the speaker are installed in the earphone housing. The filter module includes a printed circuit board, a microphone, and a filter unit. The microphone and the filter unit are respectively disposed on the printed circuit board. The filter unit is electrically connected between the microphone and the speaker.

Compared with the prior art, the present invention has the following obvious advantages and beneficial effects.

1. The filter module is arranged in the earphone. The structural design is reasonable, the space is effectively utilized, the structure is compact, and the assembly is convenient. In particular, the stability and reliability of the connection between the microphone and the filter unit are ensured, and the filtering effect is improved.

2. The filter module and the speaker are respectively disposed in different cavities, which it is beneficial to improve the filtering effect and the quality of the audio output.

3. The front and rear housings are respectively formed with the first inner cavity and the second inner cavity. Thus, the filter module and the rear housing form an integral filter module. The integral filter module is applied to the earphone. The assembly process is more convenient and flexible in application. The integral filter module is detachably connected to the front housing to facilitate maintenance and replacement of the integral filter module.

4. The overall structural design of the earphone is ingenious and reasonable. The installation between the parts is convenient, the assembly is firm, the quality of the earphone is improved, and the stability of the whole earphone during use is ensured.

DETAILED DESCRIPTION OF THE PREFERRED EMBODIMENTS

Embodiments of the present invention will now be described, by way of example only, with reference to the accompanying drawings.

Figure 1:
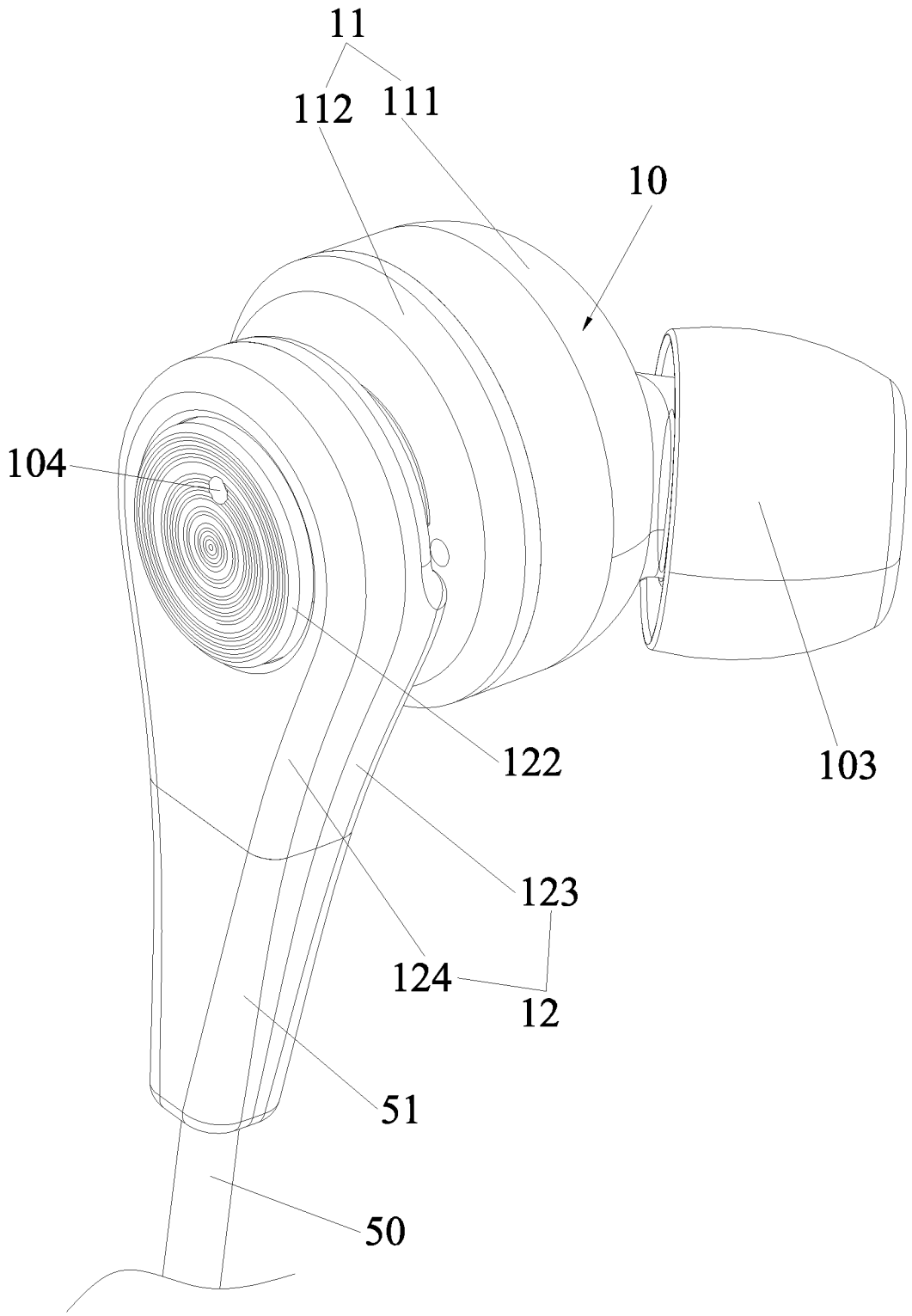
FIG. 1 is a perspective view in accordance with a preferred embodiment of the present invention.
Figure 2:
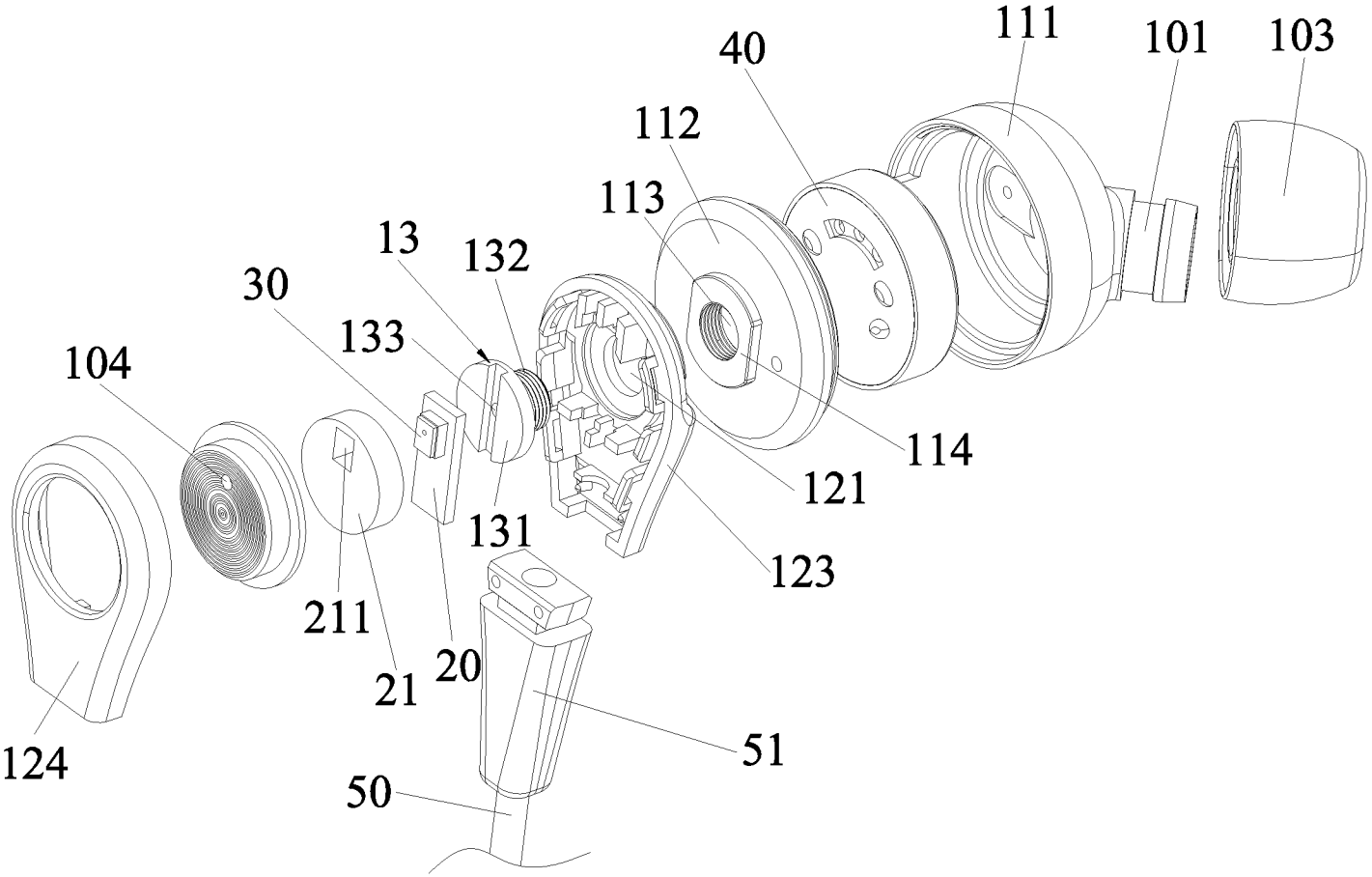
FIG. 2 is an exploded view in accordance with the preferred embodiment of the present invention.
Figure 3:
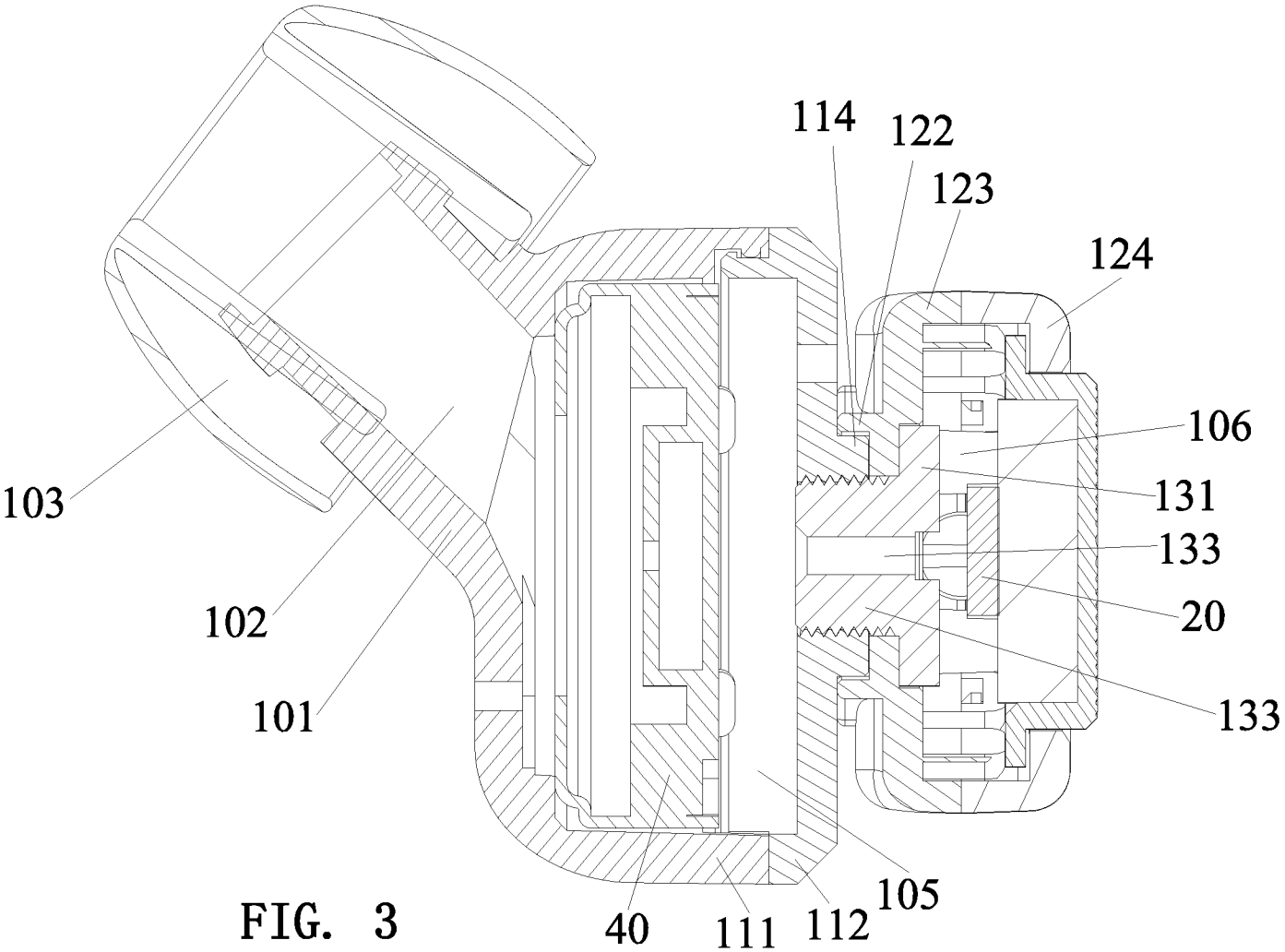
FIG. 3 is a first cross-sectional view in accordance with the preferred embodiment of the present invention.
Figure 4:
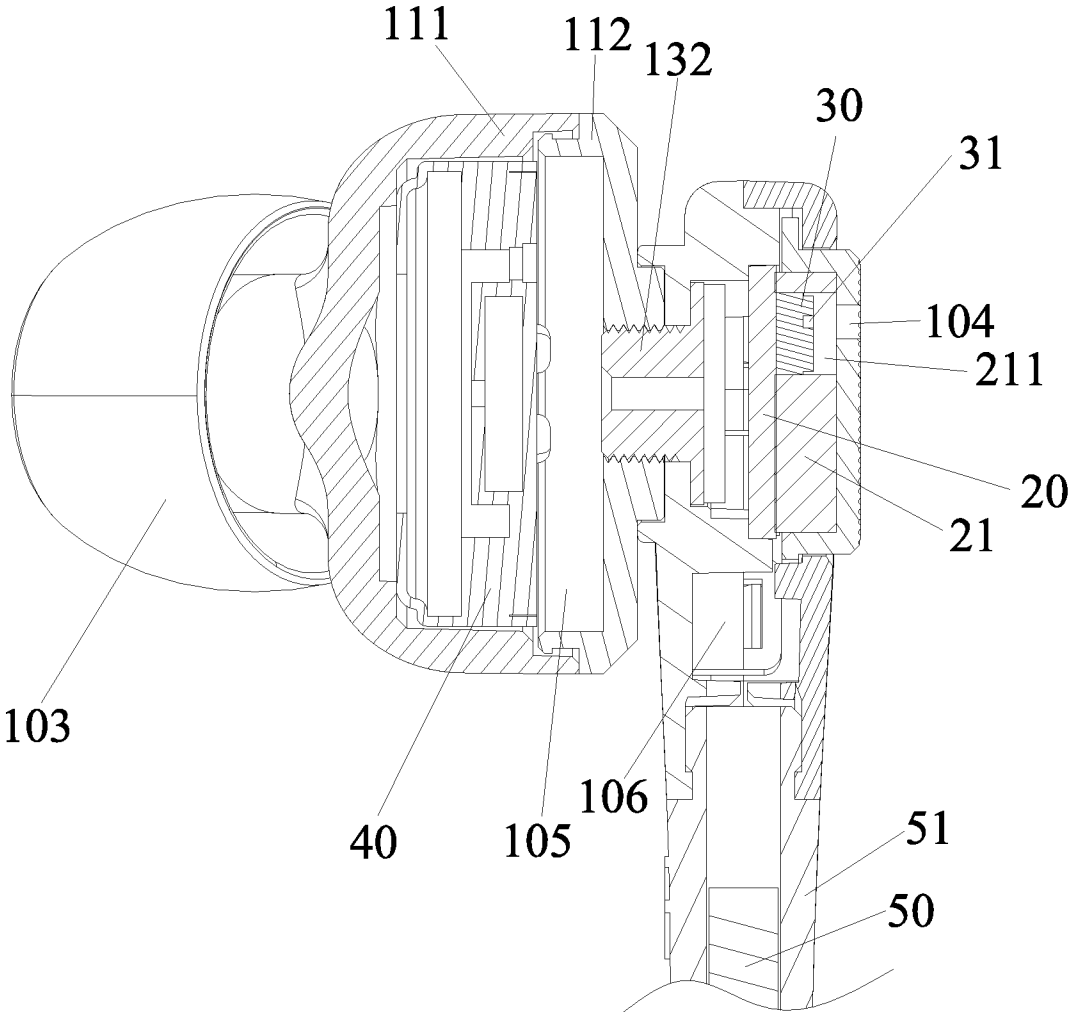
FIG. 4 is a second cross-sectional view in accordance with the preferred embodiment of the present invention.
Figure 5:
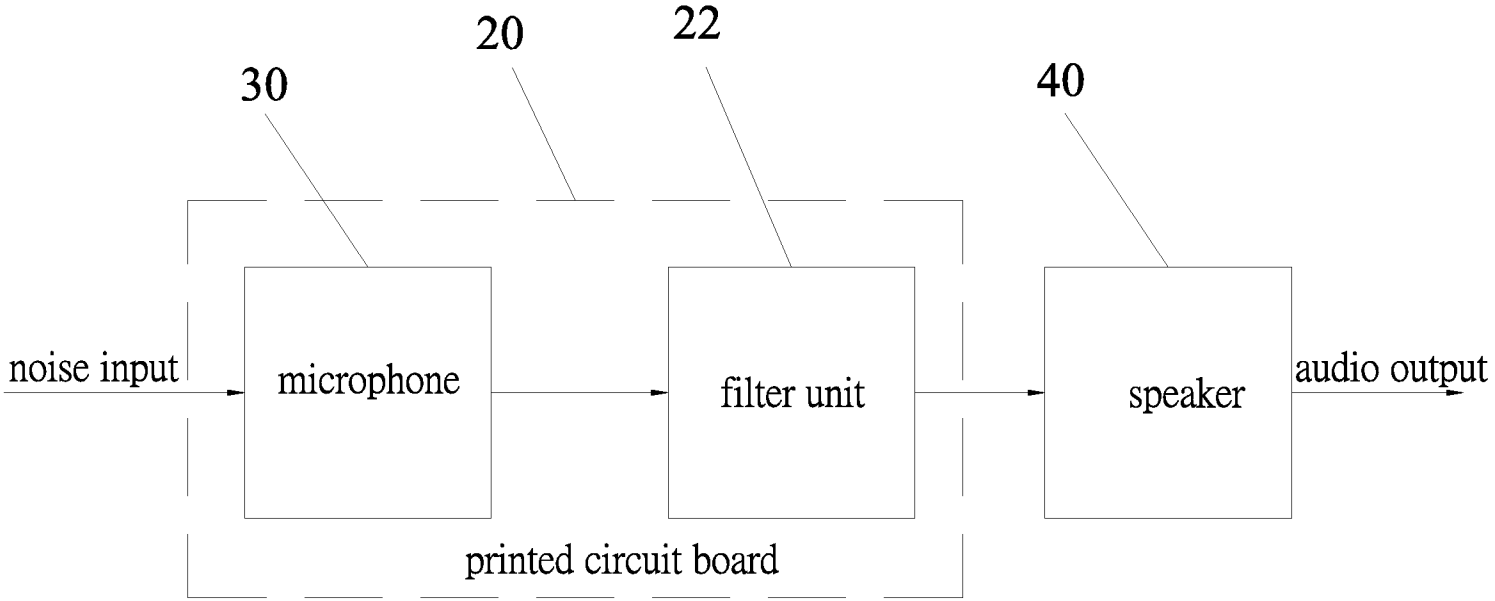
FIG. 5 is a block diagram of the preferred embodiment of the present invention.

As shown in FIG. 1 through FIG. 5, the present invention discloses a noise cancelling earphone integrated with a filter module, comprising an earphone housing 10, a filter module, and a speaker 40. The filter module and the speaker 40 are installed in the earphone housing 10. The filter module includes a printed circuit board 20, a microphone 30 and a filter unit 22. The microphone 30 and the filter unit 22 are respectively disposed on the printed circuit board 20. The filter unit 22 is electrically connected between the microphone 30 and the speaker 40. The filter unit 22 is electrically connected to the speaker 40 through a noise cancelling unit. The noise cancelling unit is a prior art and will not be described in detail hereinafter. Preferably, the microphone 30 is directly soldered to the printed circuit board 20. The filter unit 22 is generally a filtering circuit. The filtering circuit includes a capacitor, a resistor, an inductor, and so on. The filtering circuit functions as a filter. In general, the noise cancelling unit adopts a noise-cancelling circuit board provided with a noise-cancelling circuit. The printed circuit board 20 is soldered to the noise-cancelling circuit board.

A sound guiding tube 101 is connected to the front side of the earphone housing 10. The sound guiding tube 101 is formed with a sound guiding channel 102. The sound guiding channel 102 is in communication with the inner cavity. In this embodiment, the sound guiding tube 101 is obliquely, rightward disposed on the front side of the earphone housing 10. A soft rubber plug 103 is sleeved on the outer circumference of the sound guiding tube 101.

The rear side of the earphone housing 10 is formed with a sound inlet 104. The earphone housing 10 has an inner cavity. The filter module and the speaker 40 are disposed in the inner cavity, respectively. The sound inlet 104 is in communication with the inner cavity. The microphone 30 has a pickup hole 31 facing the sound inlet 104.

The printed circuit board 20 is provided with a sound collection pad 21. The sound collecting pad 21 generally adopts an EVA (Ethylene Vinyl Acetate) sound collection pad. Both the sound collection pad 21 and the microphone 30 are disposed on the rear side of the printed circuit board 20. The sound collection pad 21 is formed with a microphone mounting hole 211. The microphone 30 is installed in the microphone mounting hole 211.

The inner cavity includes a first inner cavity 105 and a second inner cavity 106 communicating with the first inner cavity 105. The first inner cavity 105 is in communication with the sound guiding channel 102 and the second inner cavity 106. The speaker 40 is mounted in the first inner cavity 105. The filter module is mounted in the second inner cavity 106. The sound inlet 104 is in communication with the second inner cavity 106.

The earphone housing 10 includes a front housing 11 and a rear housing 12. The first inner cavity 105 is located in the front housing 11. The second inner cavity 106 is located in the rear housing 12. The front housing 11 is provided with a rear through hole 113. The rear housing 12 is provided with a front through hole 121. The rear housing 12 is connected to the front housing 11 so that the front through hole 121 is in communication with the rear through hole 113. The rear housing 12 is detachably connected to the front housing 11.

Preferably, the front housing 11 is connected to the rear housing 12 through a fixing member 13. The fixing member 13 includes a base portion 131 and a mounting portion 132 having an external thread. A wire-passing hole 133 is defined in the mounting portion 132. An internal thread is formed in the rear through hole 113 of the front housing 11. The mounting portion 132 passes through the front through hole 121 of the rear housing 12 and extends out of the front side of the rear housing 12 to form a threaded connecting portion. The base portion 131 is confined within the rear housing 12. The threaded connecting portion is configured to mate with the internal thread of the rear through hole 113.

The front housing 11 is provided with a first annular portion 114 extending towards the rear housing 12. The first annular portion 114 is disposed around the rear through hole 113. The rear housing 12 is provided with a second annular portion 122 extending towards the front housing 11. The second annular portion 122 is disposed around the front through hole 121. The inner annular surface of one of the first annular portion 114 and the second annular portion 122 is mated with the outer annular surface of the other of the first annular portion 114 and the second annular portion 122.

The front housing 11 includes a first front housing 111 and a second front housing 112 connected to the first front housing 111. The rear housing 12 includes a first rear housing 123 and a second rear housing 124 connected to the first rear housing 123. The rear through hole 113 is disposed in the second front housing 112. The front through hole 121 is disposed in the first rear housing 123. A cable positioning member 51 for fixing a cable 50 is connected to the lower end of the rear housing 12.

It should be noted that the present invention is described by taking a single right earphone as an example. The structural design of the left earphone is substantially similar to that of the right earphone.

The features of the present invention are described below.

1. The filter module is arranged in the earphone. The structural design is reasonable, the space is effectively utilized, the structure is compact, and the assembly is convenient. In particular, the stability and reliability of the connection between the microphone and the filter unit are ensured, and the filtering effect is improved.

2. The filter module and the speaker are respectively disposed in different cavities, which it is beneficial to improve the filtering effect and the quality of the audio output.

3. The front and rear housings are respectively formed with the first inner cavity and the second inner cavity. Thus, the filter module and the rear housing form an integral filter module. The integral filter module is applied to the earphone. The assembly process is more convenient and flexible in application. The integral filter module is detachably connected to the front housing to facilitate maintenance and replacement of the integral filter module.

4. The overall structural design of the earphone is ingenious and reasonable. The installation between the parts is convenient, the assembly is firm, the quality of the earphone is improved, and the stability of the whole earphone during use is ensured.

Although particular embodiments of the present invention have been described in detail for purposes of illustration, various modifications and enhancements may be made without departing from the spirit and scope of the present invention. Accordingly, the present invention is not to be limited except as by the appended claims

What is claimed is:

1. A noise cancelling earphone, comprising an earphone housing, a filter module and a speaker, the filter module and the speaker being installed in the earphone housing; the filter module including a printed circuit board, a microphone and a filter unit, the microphone and the filter unit being respectively disposed on the printed circuit board; the filter unit being electrically connected between the microphone and the speaker.

2. The noise cancelling earphone as claimed in claim 1, wherein a rear side of the earphone housing is formed with a sound inlet, the earphone housing has an inner cavity, the sound inlet is in communication with the inner cavity; the filter module and the speaker are respectively disposed in the inner cavity, and the microphone has a pickup hole facing the sound inlet.

3. The noise cancelling earphone as claimed in claim 2, wherein the inner cavity includes a first inner cavity and a second inner cavity communicating with the first inner cavity; the speaker is mounted in the first inner cavity, the filter module is mounted in the second inner cavity, and the sound inlet is in communication with the second inner cavity.

4. The noise cancelling earphone as claimed in claim 3, wherein the earphone housing includes a front housing and a rear housing, the first inner cavity is located in the front housing, the second inner cavity is located in the rear housing; the front housing is provided with a rear through hole, the rear housing is provided with a front through hole; and the rear housing is connected to the front housing so that the front through hole is in communication with the rear through hole.

5. The noise cancelling earphone as claimed in claim 4, wherein the rear housing is detachably connected to the front housing.

6. The noise cancelling earphone as claimed in claim 5, wherein the front housing is connected to the rear housing through a fixing member; the fixing member includes a base portion and a mounting portion having an external thread, a wire-passing hole is defined in the mounting portion; an internal thread is formed in the rear through hole of the front housing, the mounting portion passes through the front through hole of the rear housing and extends out of a front side of the rear housing to form a threaded connecting portion, the base portion is confined within the rear housing, and the threaded connecting portion is configured to mate with the internal thread of the rear through hole.

7. The noise cancelling earphone as claimed in claim 6, wherein the front housing is provided with a first annular portion extending towards the rear housing, the first annular portion is disposed around the rear through hole; the rear housing is provided with a second annular portion extending towards the front housing, the second annular portion is disposed around the front through hole; and an inner annular surface of one of the first annular portion and the second annular portion is mated with an outer annular surface of the other of the first annular portion and the second annular portion.

8. The noise cancelling earphone as claimed in claim 6, wherein the front housing includes a first front housing and a second front housing connected to the first front housing; the rear housing includes a first rear housing and a second rear housing connected to the first rear housing; the rear through hole is disposed in the second front housing, and the front through hole is disposed in the first rear housing.

9. The noise cancelling earphone as claimed in claim 2, wherein a sound guiding tube is connected to a front side of the earphone housing, the sound guiding tube is provided with a sound guiding channel, and the sound guiding channel is in communication with the inner cavity.

10. The noise cancelling earphone as claimed in claim 1, wherein the printed circuit board is provided with a sound collection pad, the sound collecting pad is formed with a microphone mounting hole, and the microphone is installed in the microphone mounting hole.

* * * * *